US009452545B1

(12) United States Patent
Yoder, Jr. et al.

(10) Patent No.: US 9,452,545 B1
(45) Date of Patent: Sep. 27, 2016

(54) AUTO-SCRAPE MACHINE

(71) Applicant: Stiles Machinery Inc., Grand Rapids, MI (US)

(72) Inventors: Olin O. Yoder, Jr., Burton, OH (US); Pete C. Miller, Middlefield, OH (US); Ervin W. Byler, West Farmington, OH (US); Russell P. Suor, Caledonia, MI (US)

(73) Assignee: STILES MACHINERY, INC., Grand Rapids, MI (US)

( * ) Notice: Subject to any disclaimer, the term of this patent is extended or adjusted under 35 U.S.C. 154(b) by 687 days.

(21) Appl. No.: 13/801,299

(22) Filed: Mar. 13, 2013

Related U.S. Application Data

(60) Provisional application No. 61/617,898, filed on Mar. 30, 2012.

(51) Int. Cl.

| | |
|---|---|
| ***B27M 1/00*** | (2006.01) |
| ***B27C 1/00*** | (2006.01) |
| ***B27C 1/14*** | (2006.01) |
| ***B27C 1/02*** | (2006.01) |

(52) U.S. Cl.
CPC ..... *B27M 1/003* (2013.01); *B27C 1/002* (2013.01); *B27C 1/02* (2013.01); *B27C 1/14* (2013.01)

(58) Field of Classification Search
CPC ..... B27C 1/002; B27C 1/02; B27C 1/00; B27C 1/14; B27M 1/003; B27M 1/006
See application file for complete search history.

(56) References Cited

U.S. PATENT DOCUMENTS

| | | | | |
|---|---|---|---|---|
| 3,756,295 | A * | 9/1973 | Halop | B27M 1/003 144/136.1 |
| 6,660,333 | B2 * | 12/2003 | Frame | B05D 7/06 144/358 |
| 2009/0277537 | A1 * | 11/2009 | Hahn | B27M 1/003 144/371 |

* cited by examiner

*Primary Examiner* — Matthew G Katcoff
(74) *Attorney, Agent, or Firm* — Nyemaster Goode PC

(57) ABSTRACT

An auto-scrape machine that includes: a frame with a material processing surface and having a first side and a second side on opposite sides of the material processing surface; and a plurality of independently laterally moveable motorized scrape arm assemblies that comprise a rod extending over the material processing surface wherein the motorized scrape arm assemblies are engaged to the first side and the second side of the frame and have at least one knife assembly that is fixed in position when engaged to the rod such that a knife of the knife assembly engages a material being processed on the material processing surface.

20 Claims, 18 Drawing Sheets

AUTO-SCRAPE MACHINE

CROSS-REFERENCE TO RELATED APPLICATION(S)

This application claims priority to and the benefit of U.S. Patent Application Ser. No. 61/617,898 filed on Mar. 30, 2012, entitled "SCRAPE MACHINE," the disclosure of which is hereby incorporated herein by reference in its entirety.

BACKGROUND OF THE INVENTION

Hand-scraped wood planks or panels that are typically wood flooring, paneling, or components for wood cabinetry have been produced by hand using a hand scraper 1 (FIG. 1) for some time. Such hand scrapers typically include a first handle 2 and a second handle 3 that extends away from the main shaft 4 of the tool. The second handle 3 is predominantly used to provide the pulling force by the user across the surface of the wood. At the end of the main shaft 4, the hand scraper has the knife head 5 of the scraper 1 attached to it using a plurality of bolts 6 that sandwich the knife between two support blocks. In operation, individuals grasp the tool at the handles and drag the knife head across the wood being scraped while applying various amounts of downward force at various angles and across various surfaces of the wood with each stroke. The process is very labor intensive. As a result, the cost of such hand-scraped wood products is currently very high relative to other wood flooring or paneling styles/products. Nevertheless, despite the high cost of such hand-scraped products consumers still desire such materials for at least their durability and unique appearance due to the randomness of the hand production process. To date, there have not been mechanical devices or systems that have been able to produce wood material, in particular wood flooring and wood cabinetry materials, which have the same randomness of cut, variability of the type of cut, and overall look desired by consumers in the marketplace.

Some prior mechanical systems have utilized rotary cutting tools, such as a router, in an effort to automate the production of wood products that have the appearance of being hand scraped, but the panels produced by such systems are not sufficiently random or sufficiently variable in the type of cut and products produced to mimic a hand-scraped wood product and the products have not been widely accepted in the industry. Other systems endeavoring to achieve this randomness and other qualities and features of hand-scraped wood products have also utilized planers, but these systems similarly do not produce a wood product that is of sufficient randomness or having the overall look of the hand-scraped products. For example, there is no "chatter" portions on such wood products produced using a router system or a planer system and the systems typically do not have the ability to create the angled cuts at different depths and speeds that are achieved by hand scraping a wood material.

SUMMARY OF THE PRESENT INVENTION

One aspect of the present invention generally includes an auto-scrape machine that includes: a frame with a material processing surface and having a first side and a second side on opposite sides of the material processing surface; and a plurality of independently laterally moveable motorized scrape arm assemblies that comprise a rod extending over the material processing surface wherein the motorized scrape arm assemblies are engaged to the first side and the second side of the frame and have at least one knife assembly that is fixed in position when engaged to the rod such that a knife of the knife assembly engages a material being processed on the material processing surface.

Another aspect of the present invention generally includes an auto-scrape machine that includes: a frame with a processing surface configured to receive a wood paneling material, typically panels or planks, to be processed by the auto-scrape machine and having a first side and a second side on opposite sides of the material processing surface; a plurality of independently laterally moveable motorized scrape arm assemblies that comprise a rod having a longitudinal axis extending over the material processing surface wherein the motorized scrape arm assemblies are engaged to the first side and the second side of the frame and have at least one knife assembly that is fixed in position when engaged to the rod such that a knife of the knife assembly engages a material being processed on the material processing surface and wherein the motorized scrape arm assemblies are each mounted to the frame and a common motorized scrape arm assembly mounting rod that engages the plurality of scrape arm assemblies and the scrape arm assemblies have two end portions that are moveable between a plurality of different heights such that the angle of the knife assembly engagement changes; and a plurality of spaced apart press roller assemblies configured to drive the material being processed by the auto-scrape machine through the machine with sufficient force to scrape the material using the knife assemblies of the motorized scrape arm assemblies without the knife assemblies rotating; and wherein the auto-scrape machine is configured to process from about 10 to about 35 lineal feet of wood per minute and create a hand-scraped appearance on a single face of the wood.

Yet another aspect of the present invention generally includes a method of processing a wood product through an auto-scrape machine such that the wood product produced has a hand-scraped appearance comprising at least the following steps: inserting a wood material to be processed into the auto-scrape machine on a material processing surface of the auto-scrape machine; using a plurality of spaced apart press roller assemblies to drive the wood material being processed by the auto-scrape machine through the machine by using a toothed motor-driven roller to grasp a bottom surface of the wood material and drive the wood material through the auto-scrape machine adjusting the height of each side of each of a plurality of independently and laterally moveable and motorized scrape arm assemblies having a knife assembly engaged to a longitudinally extending rod of the motorized scrape arm assemblies; and passing the wood material into engagement with the knife assemblies of the motorized scrape arm assemblies and with the knife assemblies not rotating about the longitudinal axis of the longitudinally extending rod as the motorized scrape arm assemblies move laterally back and forth across at least a portion of a top surface of the wood product being processed to thereby create a hand-scraped appearance on the top surface of the wood product.

These and other aspects, objects, and features of the present invention will be understood and appreciated by those skilled in the art upon studying the following specification, claims, and appended drawings.

DETAILED DESCRIPTION OF EMBODIMENTS

Figure 1:
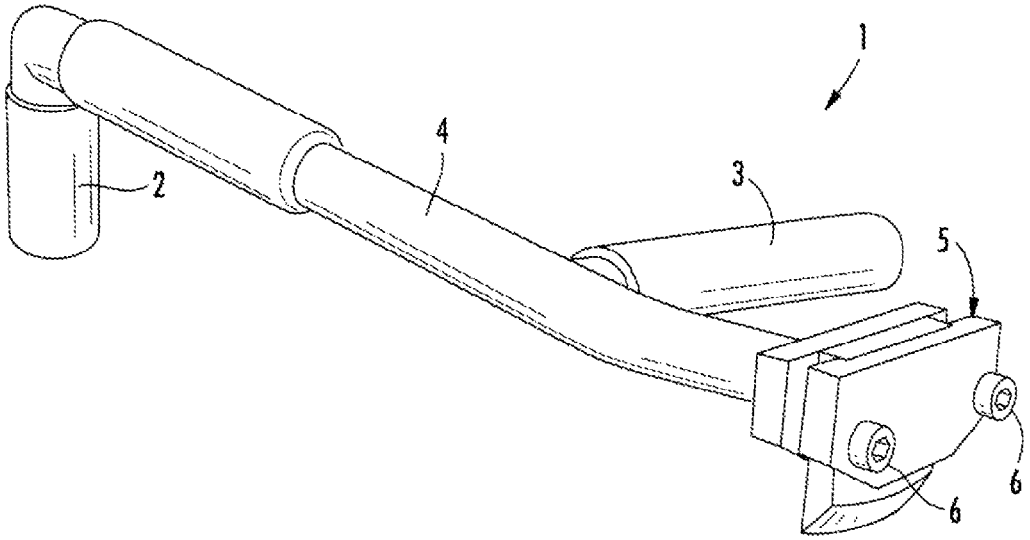
FIG. 1 (PRIOR ART)
FIG. 1 is a perspective view of a traditional hand-scraping tool.
Figure 2:
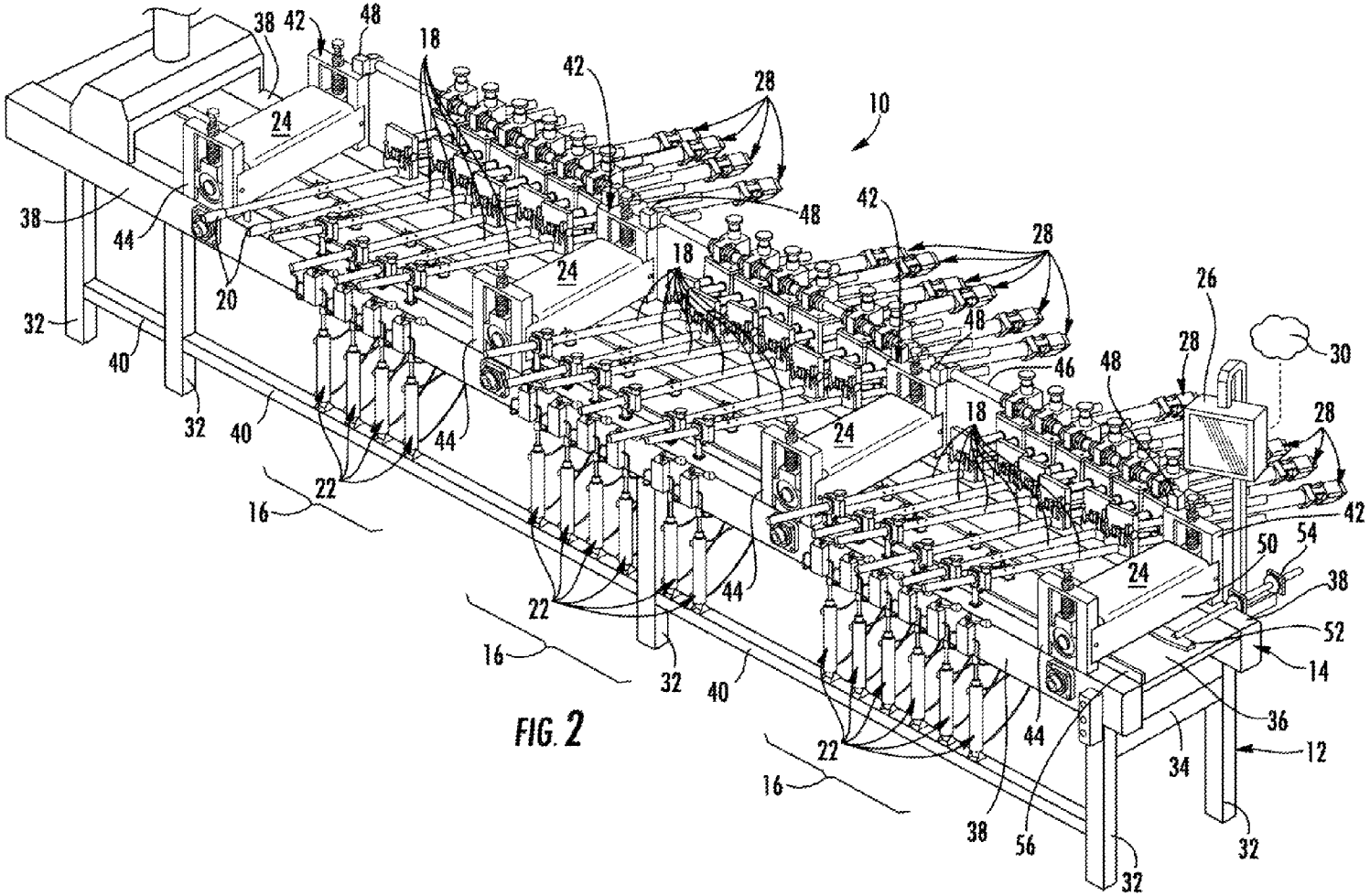
FIG. 2 is a perspective view of an auto-scrape machine according to an aspect of the present invention.

For purposes of description herein, the terms "upper," "lower," "right," "left," "rear," "front," "vertical," "horizontal," and derivatives thereof shall relate to the invention as oriented in FIG. 2. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIG. 2, the auto hand-scrape device 10 typically includes a mounting frame 12, frame top 14, one or more sets of scrape arm assemblies 16 containing automatic scrape arms 18, optional hand-actuated scrape arm(s) 20, scrape arm vertical movement assemblies 22, press roller assemblies 24, one or more display panels 26, and scrape arm servo drive assemblies 28. The auto-scrape machine 10 may include a computer system operably connected to or integrated with the display panels 26 that is optionally connected to a computer network, the internet, or an intranet system 30. In one example, the computer system of the present invention can be any Programmable Logic Controller (PLC) which has the capacity for numerous varying programs within its storage capabilities, such as at least 100 programs. One or more other computer controls can be utilized in connection with the present invention. Each of the mechanical components can be individually controlled or common elements may be jointly controlled using the computer system(s) of the present invention. The computer systems may control the auto-scrape machine. The computer systems can also permit various types of variables to be changed including any or all speeds of the various components, height settings and speed of the material being processed.

The auto-scrape machine 10 is designed and made to mechanically replicate a true hand-scraped look on the face of wood flooring, cabinetry, trim, treads, risers, and furniture parts. In one example, the auto-scrape machine is about 70 inches high, about 40 inches in width, and about 15 feet in length. The auto-scrape machines typically are able to use the cutting edge of a plurality of knife assemblies 100 (see FIG. 7), which includes a moulder cutting knife that has been profiled to be firmly held as the wood piece passes below. The material being scraped away from the face of the wood being processed is scraped away without the knife assemblies rotating, as they would be in the case of a moulder or planer. The auto-scrape machine creates the hand-scraped, distressed look to the piece. However, the machine may be sized and adjusted for various inputs of different width material and different levels of the amount of scraping desired. In particular, the display 26 may be operably connected to the computer system discussed above that stores a variety of preprogrammed patterns for the machine, and the machine may automatically adjust the systems described herein to replicate previous "random" appearance patterns into use by the system. The system may automatically adjust the various adjustable parameters herein or, unless otherwise noted in the discussion herein, these parameters may be manually adjusted. The computer system may adjust the various patterns based upon the type of wood and hardness and physical properties of the wood being processed by the system. For example, if harder wood, such as oak, is utilized, the system can adjust various parameters based upon the raw material being utilized as compared to a softer wood, such as pine, being processed. For brevity, the auto-scrape machine 10 is described herein for use in the manufacture of hardwood flooring, but any of the above wood components may be processed by the present invention.

The frame 12 typically includes a plurality of upwardly extending legs 32 and support cross members 34. The frame 12 supports the frame top 14. Frame top 14 typically includes a material processing surface 36 supported by side support sections 38, which serve to receive and mount various components of the system as will be further described below. The frame 12 may also include secondary lower side supports 40 on each side of the frame. The secondary lower side supports 40 are typically positioned proximate the floor that adds structural stability to the overall frame 12.

Frame 12 typically further includes a plurality of servo arm assembly supports 42 and a plurality of press roller assembly mounting supports 44 mounted on the opposite side support section of the frame 12. A servo arm assembly mounting rod 46 typically extends between the servo arm assembly supports with the servo arm assembly mounting rod 46 engaged typically by a weld directly to the servo arm assembly supports or to a mounting block 48 typically positioned on the top of the servo arm assembly supports and welded to the servo arm assembly supports.

The press roll mounting assembly supports 44 are typically mounted substantially directly across from the servo arm assembly supports or, more typically, directly across from the servo arm assembly supports 42. Both the servo arm assembly supports 42 and the press roll mounting assembly supports 44 are substantially C-shaped and include a height adjustment nut and bolt mechanism to move the height of the press roll assemblies 24 in the system. In FIG. 2, the interior of the press roll assembly 24 is guarded by the safety shield 50.

The material support surface 36 typically is operably engaged to a material width retention member 52 that extends at least substantially the entire length of the auto-scrape machine and provides horizontal force to retain the material being processed or may optionally not provide force but merely frictionally hold the material being processed in position. The retention member 52 is adjustable via an adjustment bracket system 54 mounted to the side support section 38. The adjustment system allows for the retention member to be horizontally moved to accommodate different width wood material being processed through the auto-scrape machine 10. An opposing retention member 56 is typically mounted to the secondary side supports. The opposing retention member is also typically not horizontally adjustable but provides a fence (parallel to the path of wood processing) to retain the wood along the processing path of the device. The retention member 52 and the opposing retention member are both typically a stable material, such as a wood, a plastic, or a metal material, which is stable enough to guide the wood being processed. When the fence is metal, it may be made of a steel or aluminum. As shown in FIGS. 3A, 3B, 4A, 4B, and 14, the retention member 52 may have carved out sections 58 to receive the knife 60 and the knife assembly 100 and thereby allow the knife to pass over to the edge of the wood material being processed. The upper surface of the carved out section 58 is lower than the depth of cut on the wood material being processed. Optionally, a carve-out section from the retention member and the opposing retention member may be presented in the opposing retention member. In such a scenario, the knife blade would be allowed to pass both over and across the side surfaces of the wood material being processed. This adds to the random appearance of the scraping being conducted by the automatic scrape arms.

Figure 3A:
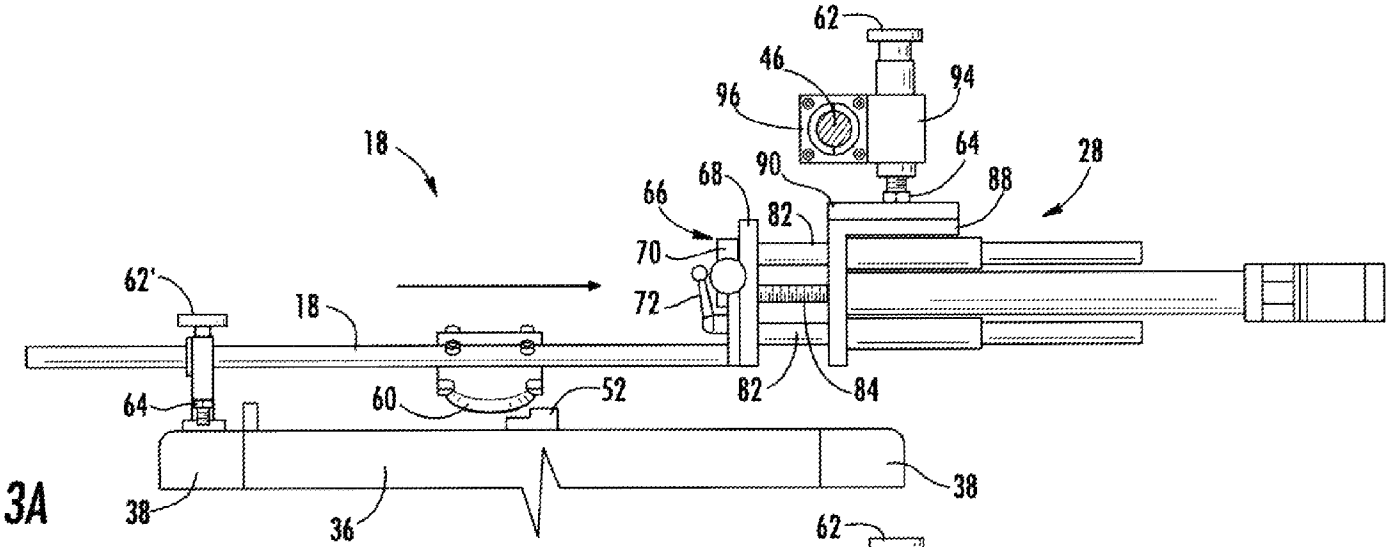
FIGS. 3A and 3B are elevated side views demonstrating lateral movement of the automatic scrape arm assemblies according to an aspect of the present invention.
Figure 3B:
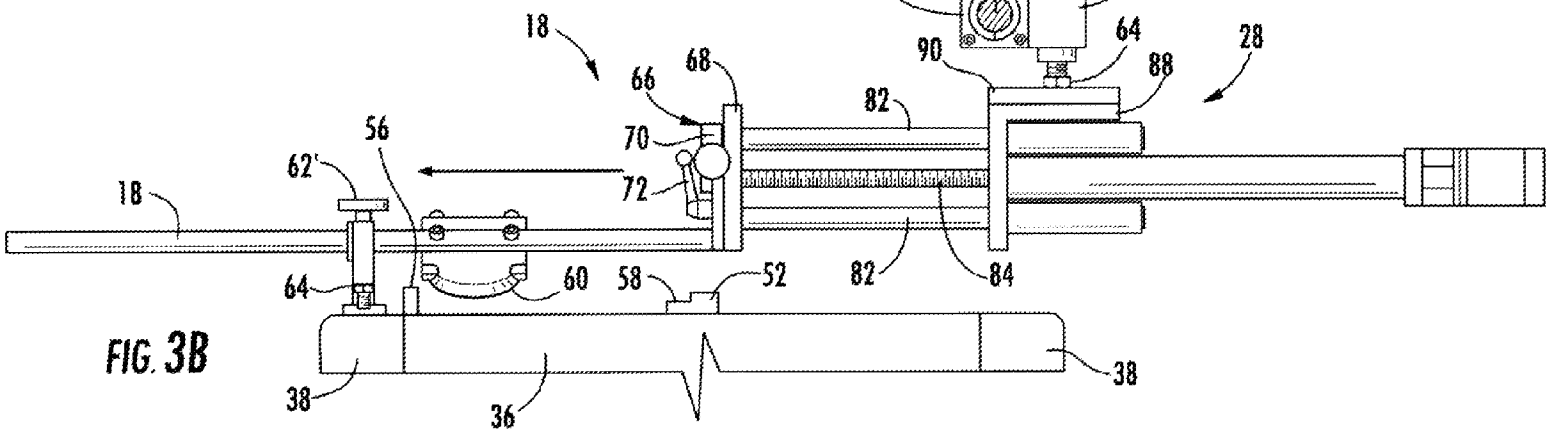
Figure 4A:
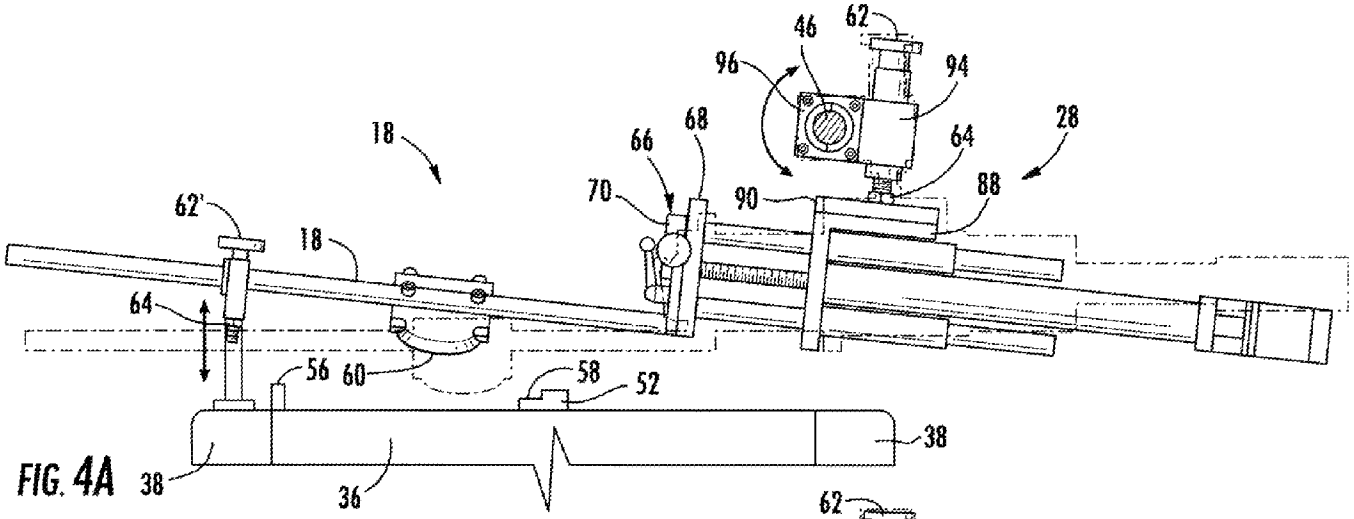
FIGS. 4A and 4B show the scrape arm assembly tilt movement adjustability according to an aspect of the present invention.
Figure 4B:
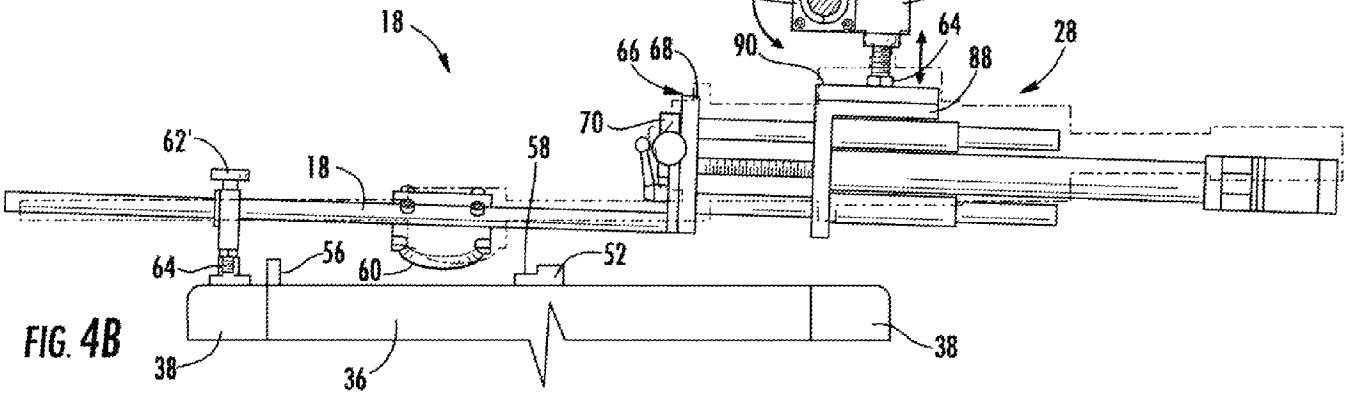

FIGS. 3A and 3B of the present application shown, the scrape arm servo assembly 28 and overall automatic scrape arm assembly 18 and its lateral movement capability across the material processing surface of the auto-scrape machine. As will be discussed in more detail later, the scrape arm servo assembly and scrape arm vertical movement assembly, the upper portion of which is shown in FIGS. 3A and 3B, may be actuated. This is shown in FIGS. 4A and 4B. As shown in FIGS. 4A and 4B, the scrape arm servo assembly 28 may be rotated about the servo arm assembly mounting rod 46, such that the height and cut angle of the knife may be adjusted between preset adjustments or an infinite number of manual adjustment settings between a lowest setting and a highest rotating setting. Similarly, the height of the scrape arm vertical movement assembly may be adjusted and randomized between an uppermost height and a lowest height. Both adjustments may be staged between a predetermined amount of set height adjustments and controlled by a computer control unit to allow for automation of a variety of preset programs for processing various materials and patterns.

As shown in the drawings, the height adjustments are manual process height adjustment systems that are threaded nut and bolt systems. The threaded nut and bolt systems include a hand actuating end 62 and 62' on both the scrape arm servo assembly (see 62) and the scrape arm vertical movement assembly (see 62'). The hand actuating ends are typically held in place by bolts 64. Conceivably, another adjustable anchoring device could be used.

Figure 5A:
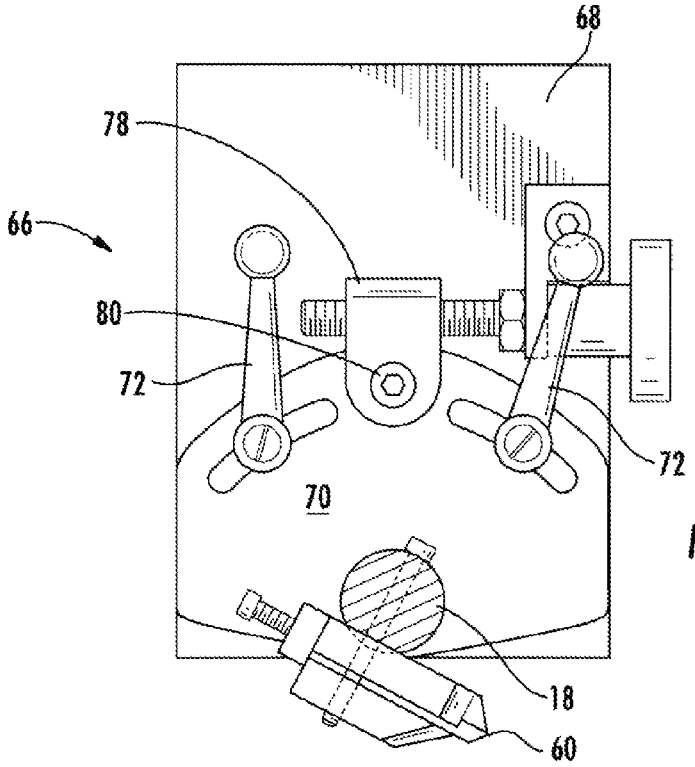
FIGS. 5A and 5B show elevated front views of the blade tilt adjustment assembly according to an aspect of the present invention.
Figure 5B:
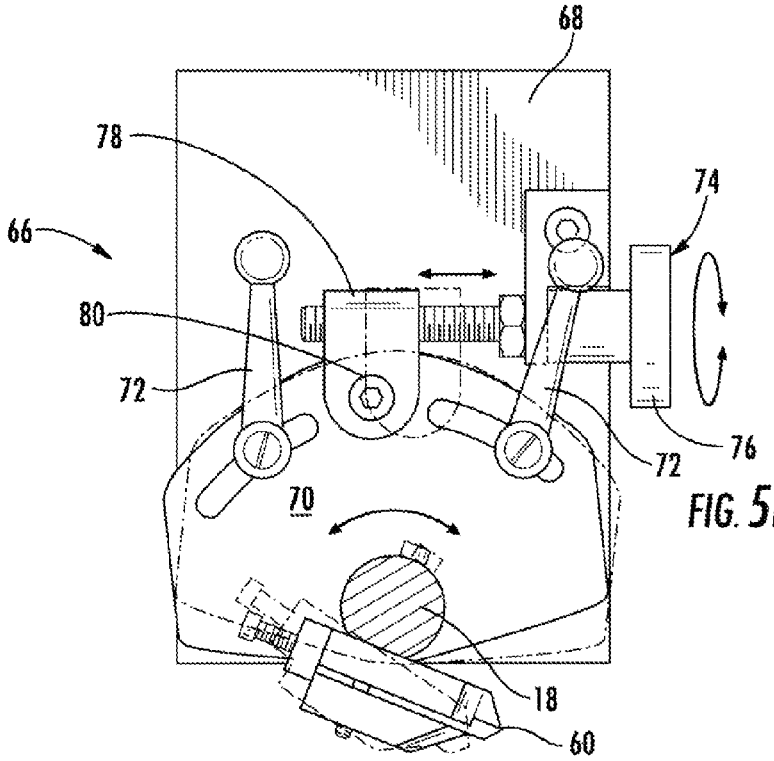

FIGS. 5A and 5B show a blade tilt adjustment assembly 66 operably connected to the scrape arm servo assembly by a servo assembly engagement member 68 that is typically a planar, rectangular prism shaped metallic (steel) member. The automatic scrape arms 18 are engaged to a blade tilt adjusting clamp 70 that is rotatably movable rotationally to adjust the angle of the blade of the knife 60. In operation, the locking handles, which move between an engaged positions applying a force to the blade tilt adjusting clamp and a disengaged position which loosens the clamp and allows for rotational movement of the arm through lateral adjustment of the overall clamp, as shown in FIG. 5B. As shown in FIG. 5B, once the locking handles 72 are loosened, a threaded adjusting member that has a cap section 76 may be rotated to laterally move the bridging member 78, which is operably engaged to both the threaded adjusting member and the blade tilt adjusting clamp. The bridging member 78 is typically engaged to the blade tilt adjusting clamp by a bolt 80 or other mechanism, such as by a weld. Once repositioned, the locking handles are rotated in a clockwise direction and provide an engaging force to lock the automatic scrape arm in a given position. While the system shown for rotating the automatic scrape arm is a manual adjustment system, as with the other components of the auto-scrape machine, this adjustment may also be controlled by a computer control unit and have defined stages of rotation. The amount of staged rotation selectivity may be predetermined within a wide variety of ranges. The use of predetermined adjustments, as with other adjustments of the auto-scrape machine, allows for computer control and replication of established patterns for scraping the material that is processed by the auto-scrape machine.

Figure 6:
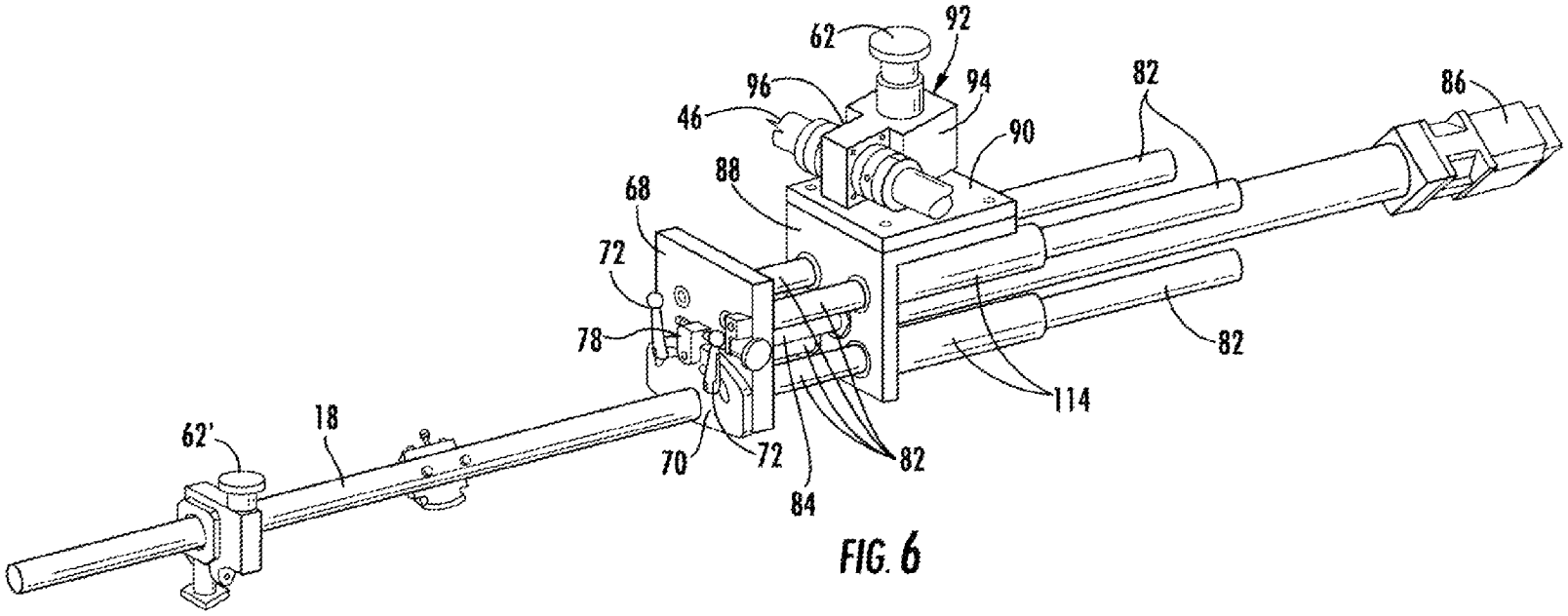
FIG. 6 is a perspective view of an automatic scrape arm according to an embodiment of the present invention.

As shown in FIG. 6, the blade tilt adjusting assembly is engaged to a plurality of stabilizing bars 82, which are typically four stabilizing bars spaced at the corners of a rectangular pattern. The stabilizing bars are used to prevent inadvertent rotation of the automatic scrape arms 18 as the material is processed by the auto-scrape machine. The stabilizing bars are necessary due to the amount of force being frictionally applied by the knife to the material being processed. Typically, the stabilizing bars 82 and the actuating piston 84, which is operably connected to the servo motor 86, pass through the generally L-shaped bracket 88 and are connected to the servo assembly engagement member 68. The stabilizing bars and actuating piston are mounted in bearings located within the L-shaped bracket to allow the bars to laterally move back and forth without any rotation and thereby move the knife in a generally lateral motion back and forth across the material being processed. The L-shaped bracket is generally engaged on the top surface to the scrape arm servo assembly mounting member 90. The scrape arm servo assembly mounting member is typically engaged to a mounting block 92 that has a main body portion 94 that is typically cubic in an integrated servo mounting rod receiving portion 96. As shown in FIGS. 4A and 4B, the hand actuating end 62 may be adjusted to move the scrape arm servo assembly in at least substantially vertical direction between a lowest position, where the knife cuts the deepest toward the servo side, and a highest position, where the knife may not engage the portion of the material being processed by the auto-scrape machine proximate the scrape arm servo assembly.

Figure 7:
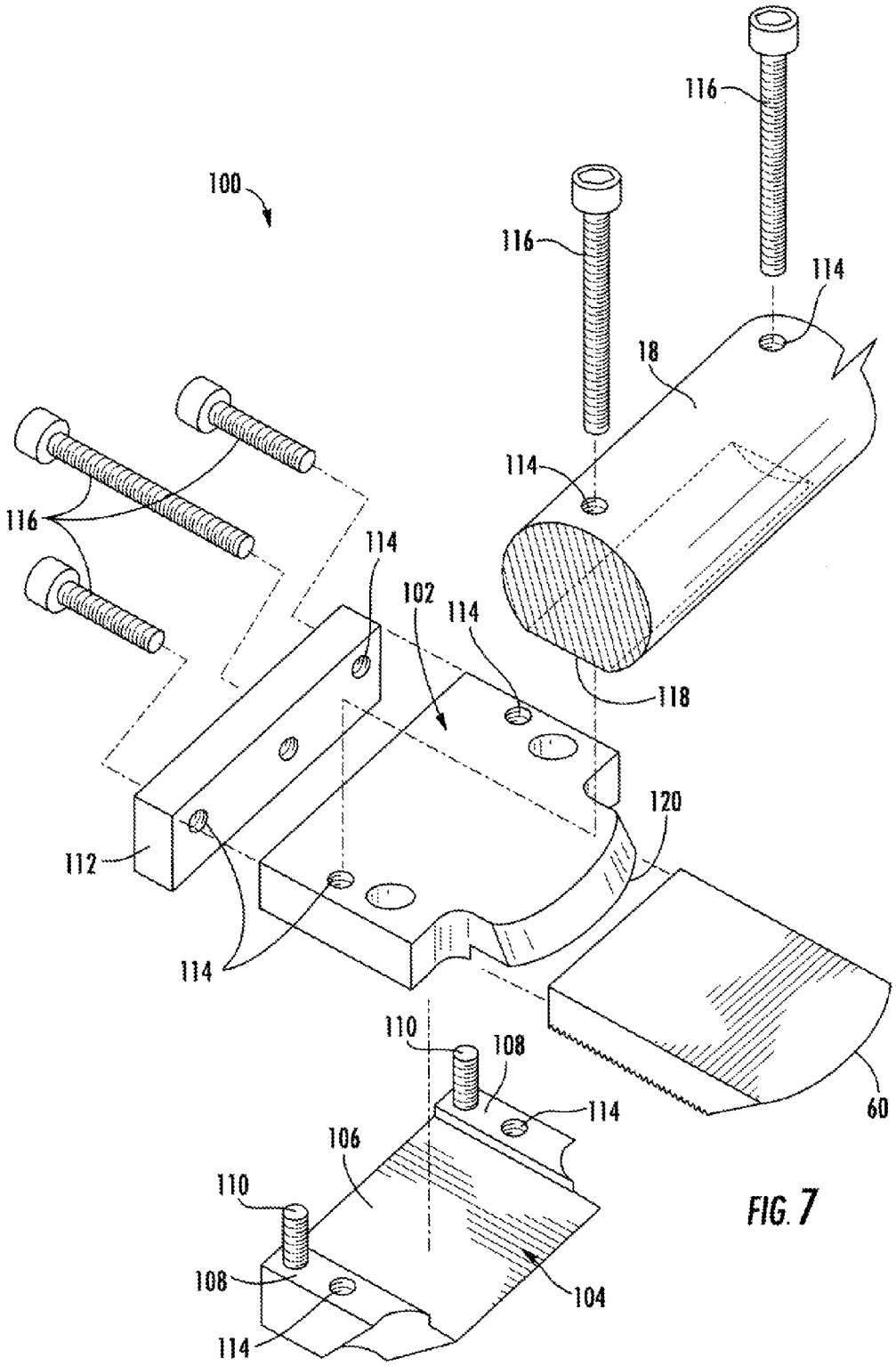
FIG. 7 is an exploded view of a knife assembly according to an aspect of the present invention.
Figure 8:
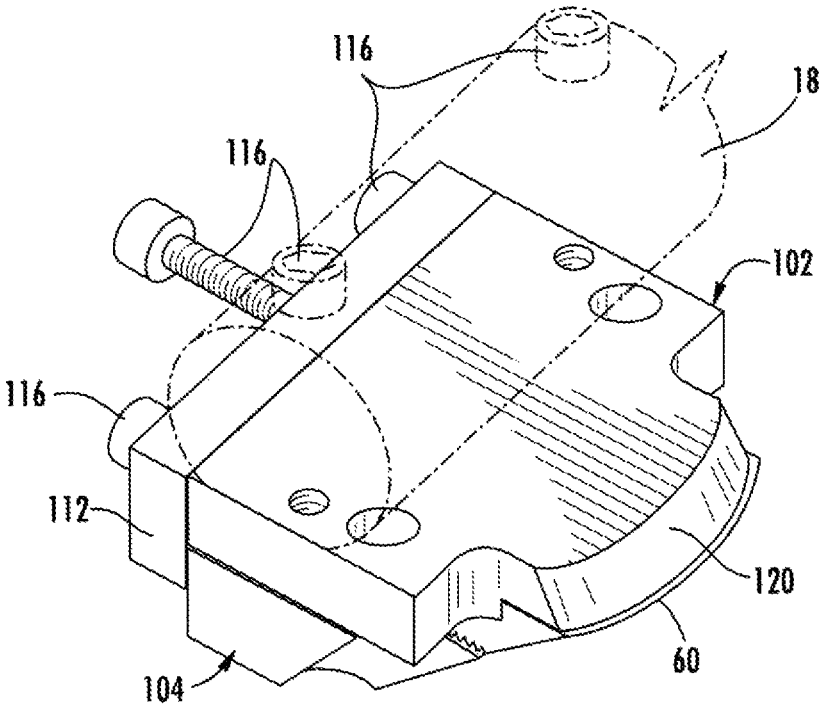
FIG. 8 is a perspective view of a knife assembly according to an aspect of the present invention.

The knife assembly 100 is generally shown in FIGS. 7 and 8. The knife 60 is typically spaced between an upper knife support member 102 and a lower knife support member 104. Both the upper knife support member and lower knife support member are typically made of solid metal material to provide retention support to the blade as the material is being processed through the auto-scrape machine. Typically, the lower knife support member includes a planar knife-receiving section 106 and side sections 108. The side sections 108 may include integrally formed or upper knife support member receiving pegs 110 that are received in apertures in the bottom surface of the upper knife support member 102. A rectangular prism-shaped rearward support member 112 contains threaded apertures 114 which, along with the threaded apertures of the upper knife support member; the lower knife support member; and the threaded fasteners, which are typically hexagonal head bolts 116, operate to frictionally retain the knife 60 in position and form the assembled knife assembly 100 as shown in FIG. 8. Threaded apertures 114 are typically provided in the automatic scrape arm 118 for mounting the knife assembly 100 to the automatic scrape arm (or hand-scrape arm) 20 using bolts 116. As can be seen in FIG. 8, the automatic (or hand actuated) scrape arm assemblies 18, 20 typically have a flat planar portion 118 that faces the knife assembly 100 and provides for a firmer engagement of the knife assembly 100 with the scrape arms and one that is less likely to succumb to rotational forces applied to the knife assembly by the material as the material passes through the auto-scrape machine. Typically, the upper knife support member has a shaped end 120. The shaped end 120 is typically shaped to substantially correspond to the cutting edge of the knife 60 to provide maximum support to the knife and prevent breakage of the knife as material is processed through the auto-scrape machine. Additionally, knife 60 typically has a jagged tooth-containing surface 122 that provides greater resistance to frictional movement when the knife assembly is frictionally held in place.

Figure 9:
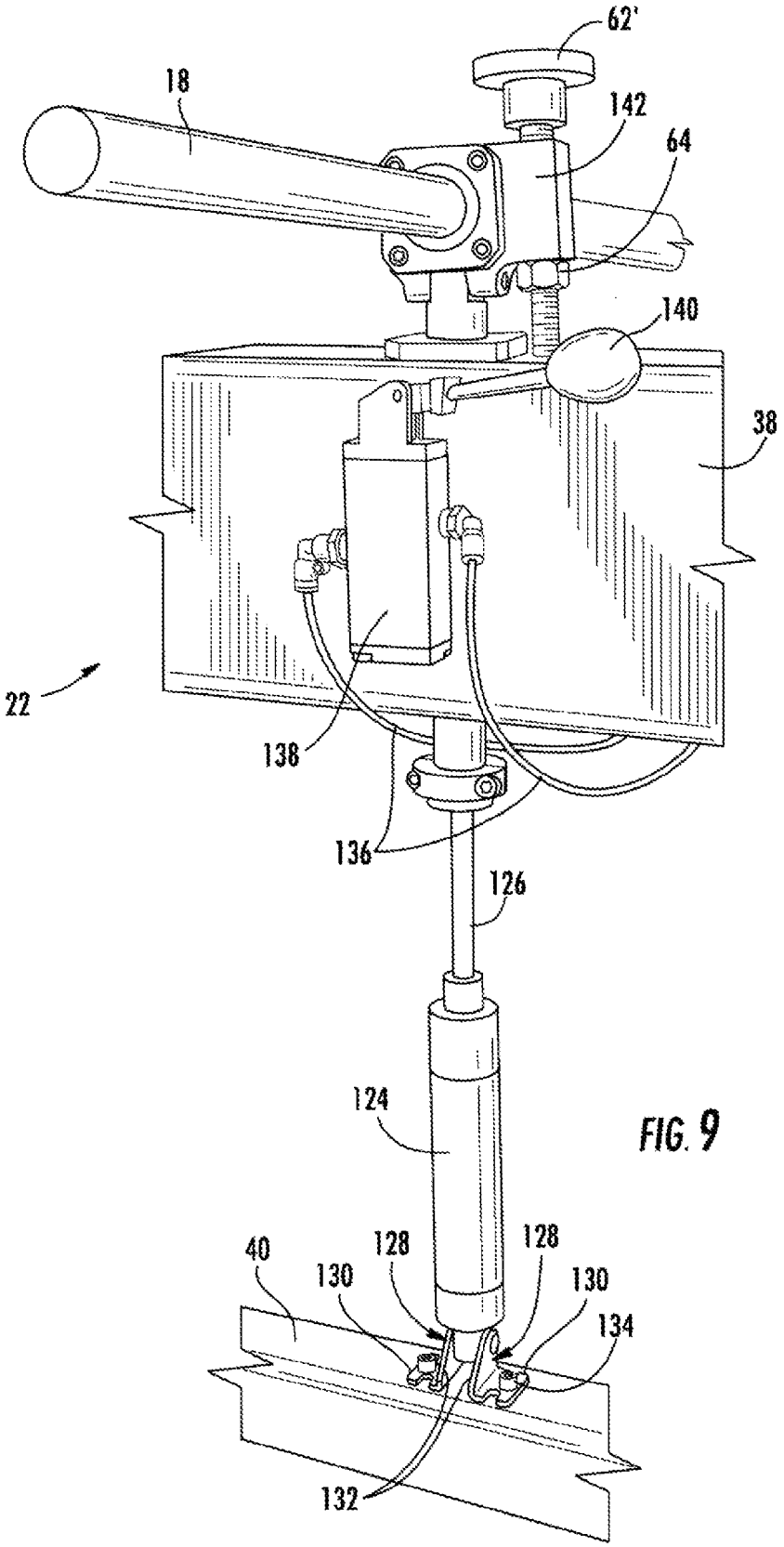
FIG. 9 is a perspective view of a scrape arm vertical movement assembly according to an aspect of the present invention.

FIG. 9 shows an enlarged view of the scrape arm vertical movement assembly 22. As shown, the scrape arm vertical movement assembly includes a pneumatic or hydraulic actuated cylinder 124. The pneumatic or hydraulic cylinder is typically a pneumatic cylinder having a cylinder actuating rod 126. The cylinder actuating rod 126 is operably connected to the end of the automatic scrape arms 18 distal from the scrape arm servo assembly. One end of the cylinder 124 is engaged using bracket 128, which have a secondary side support engaging portion and an upwardly extending portion 132. The secondary side support engaging portion is engaged to the secondary side support 40 of the frame 12, typically by a bolt or other fastener 134 or, alternatively, a weld. The cylinder 124 is typically mounted to the upwardly extending portion 132 using a bolt that bridges the upward extending portions and is positioned through an aperture in an end of the cylinder 124. Pneumatic or hydraulic lines 136 are in operable communication with a control regulator 138. The control regulator has an engaging and disengaging switch 140, which is shown as a handle that is actuated between an engaged and disengaged position. When the individual control regulators of each individual scrape arm vertical movement assembly are engaged, the system may slowly or abruptly provide an upward force to the automatic scrape arms 18. This further increases the randomness of the appearance of the scrapes of the processed material. Each individual scrape arm vertical movement assembly may be independently controlled and adjusted to move abruptly or smoothly or even to move at all. For example, the arms 20 may more in slow rhythmic patterned movements covering three inches to four inches for ten seconds and then the same arms could move rapidly back and forth covering five to six inches in a more rapid lateral back and forth motion and then optionally revert to another pattern, including the initial pattern. Additionally, as discussed previously, the hand actuating ends of threaded members may be moved and the bolt 64 adjusted to regulate the total distance of possible travel for the vertical movement of the scrape arm 18 at the end attached to the scrape arm vertical movement assembly 22. The vertical height adjusting and regulating bracket 142 typically has a hand actuating and bolt engaging end that engages the adjustment mechanism via an aperture that typically passes through the vertical height adjusting and regulating bracket 142, such that a nut is attached below the bracket 142 and the hand actuating end is positioned above the bracket 142. Another portion of the bracket typically receives the end of the scrape arm 18 and has bearings to allow the scrape arm 18 to move laterally through the aperture in the bracket 142. Bracket 142 is typically further attached to the top surface of the side support section 38. This adjustment could also be automated.

Figure 10:
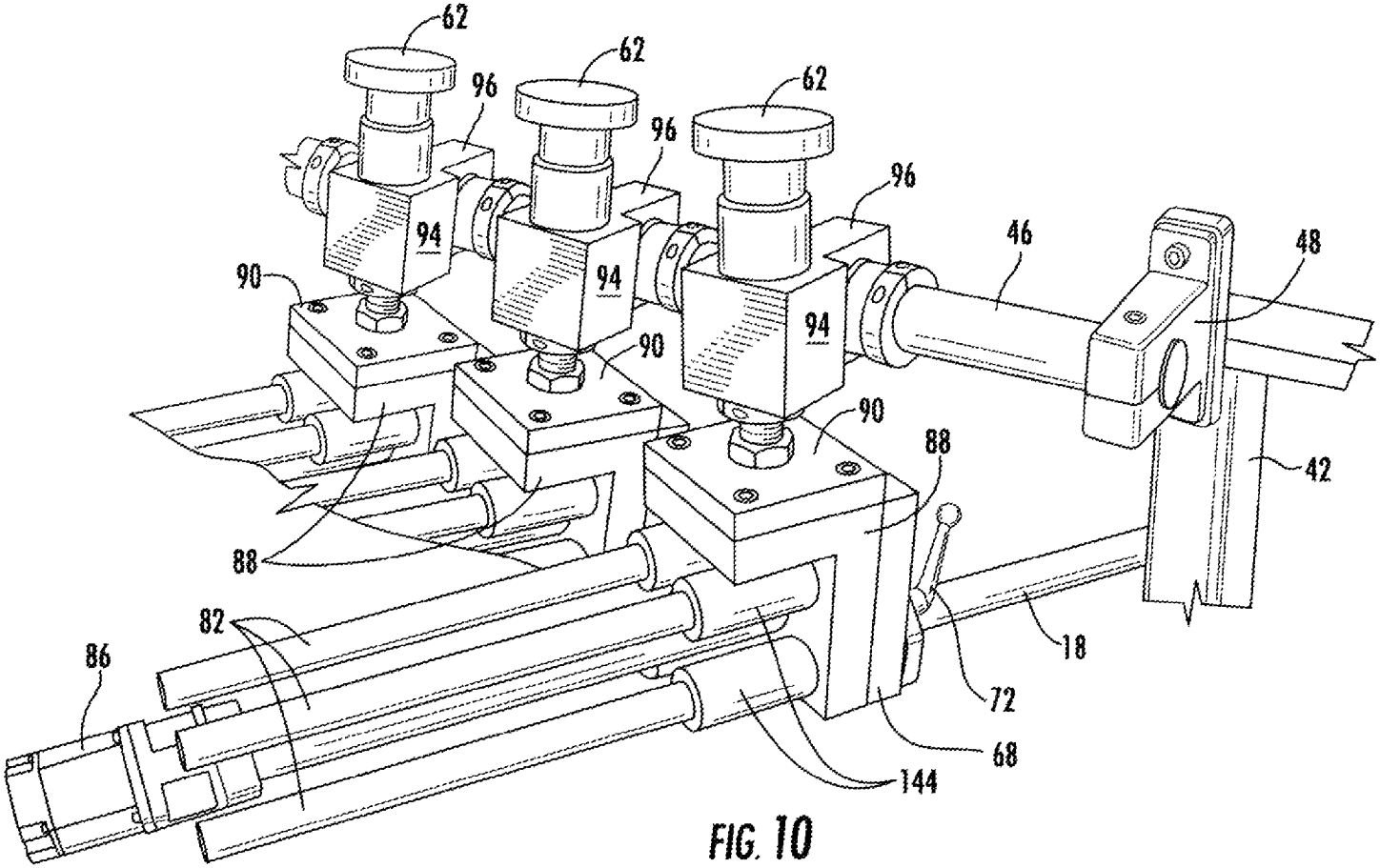
FIG. 10 is a perspective view of a scrape arm servo assembly according to an aspect of the present invention.

FIG. 10 is an alternative view of a scrape arm servo assembly 28 according to the present invention. This angle shows the support rod receiving collars 144 that are typically engaged to the L-shaped bracket 88 on the servo motor side of the L-shaped bracket 88. These provide added support to the support rods.

Figure 11:
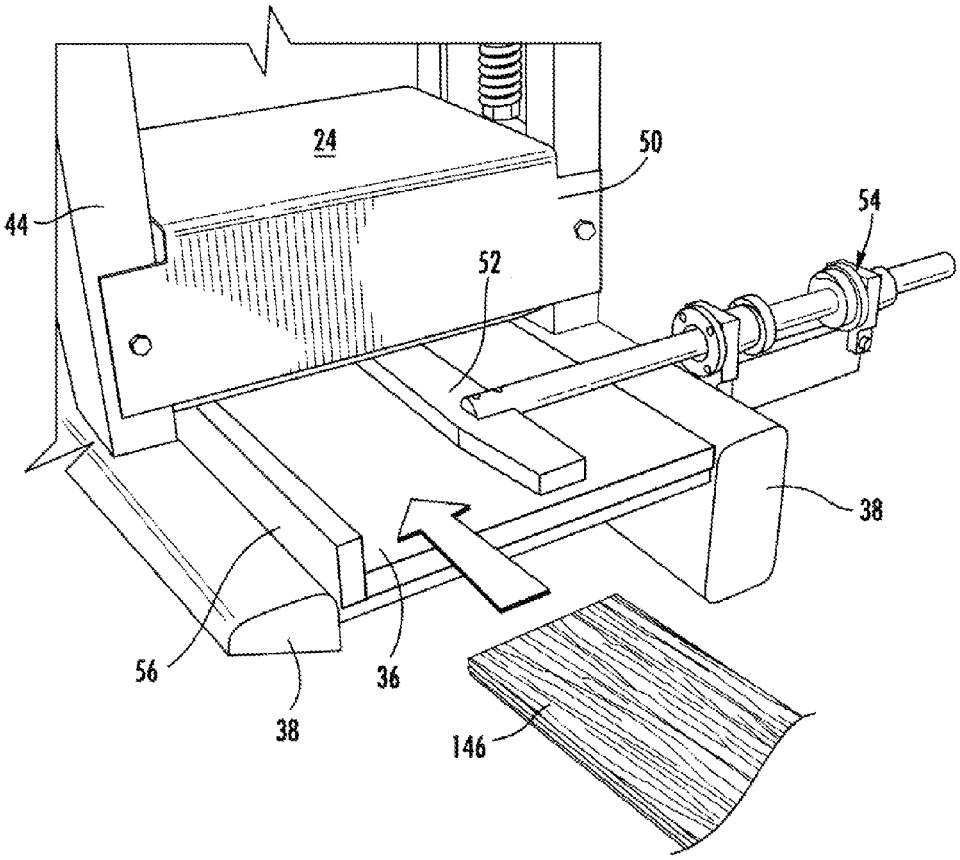
FIG. 11 is a perspective view of the feed entry press roller assembly end of the auto-scrape machine according to an aspect of the present invention.

As shown in FIG. 11, a panel of wood to be scraped by the auto-scrape machine is inserted into the feed end of the auto-scrape machine between the adjustable retention member 52 and the opposing retention member 56. The adjustment bracket system 54, which is shown in a single position in FIGS. 2 and 11 at the feed end of the auto-scrape machine but the auto-scrape machine may have multiple such systems spaced along the feed path length of the auto-scrape machine to provide support for the retention member 54 and allow movement of the retention member 54 to accommodate different widths of wood material 146 being processed by machine 10. The panel of wood 146 is fed into the machine 10 until the first press roller assembly 24 grasps and pulls the wood 146 through the length of the machine 10.

Figure 12:
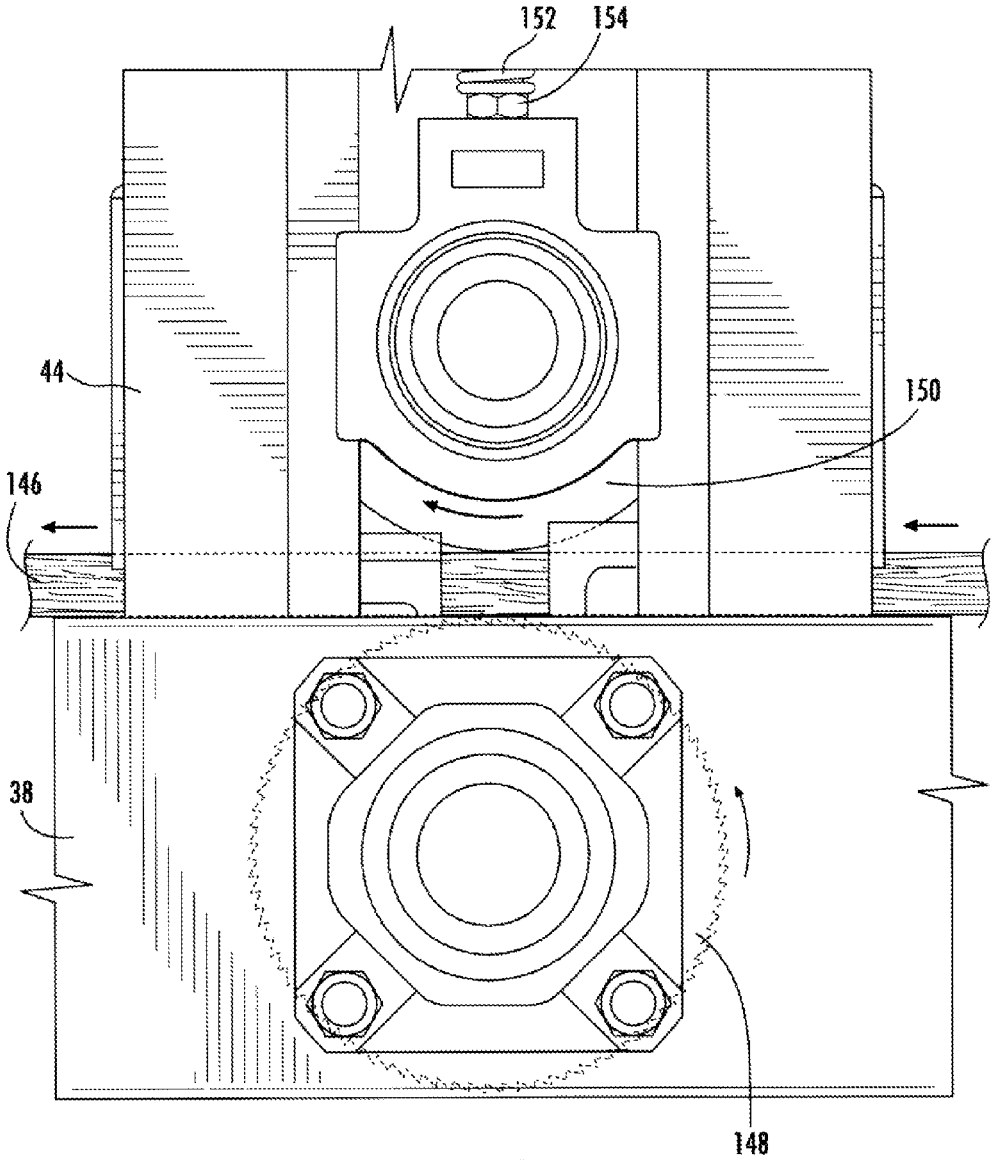
FIG. 12 is an elevated end view of a press roller assembly according to an aspect of the present invention.
Figure 13:
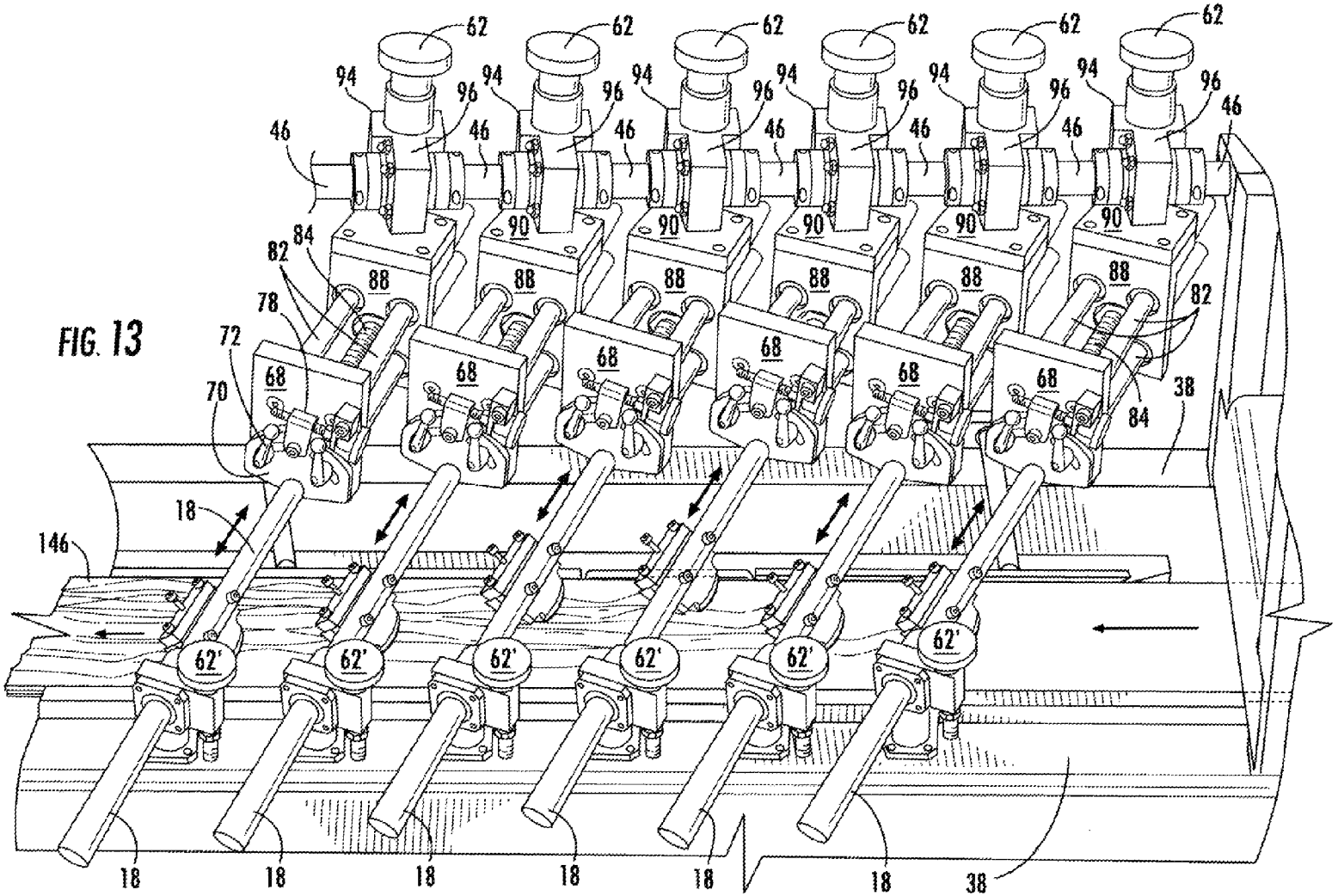
FIG. 13 is a perspective view showing wood material being processed by a set of scrape arm assemblies according to an aspect of the present invention.

As shown in FIG. 12, the press roller assembly includes motor-driven, wood-engaging rollers 148, 150. The wood-engaging roller 148 is a lower wood-engaging roller that has a jagged tooth-containing surface that grasps the bottom surface of the wood material being scraped and drives the wood material through the auto-scrape machine 10. The upper wood-engaging roller 150 rotates and typically provides a spring-biased downward force to the top surface of the wood being processed. The upper wood-engaging roller is typically smooth, so as not to harm the top surface of the wood 146 being processed by passing through machine 10. The downward force supplied by the upper wood-engaging roller 150 is regulated by the spring mounted to the press roll mounting assembly supports 44, which can be adjusted by actuating the nuts and threaded bolt 154 that passes through the center of the spring 152, but can also be adjusted by other manual or automatic methods/systems, such as a pneumatic system.

Figure 14:
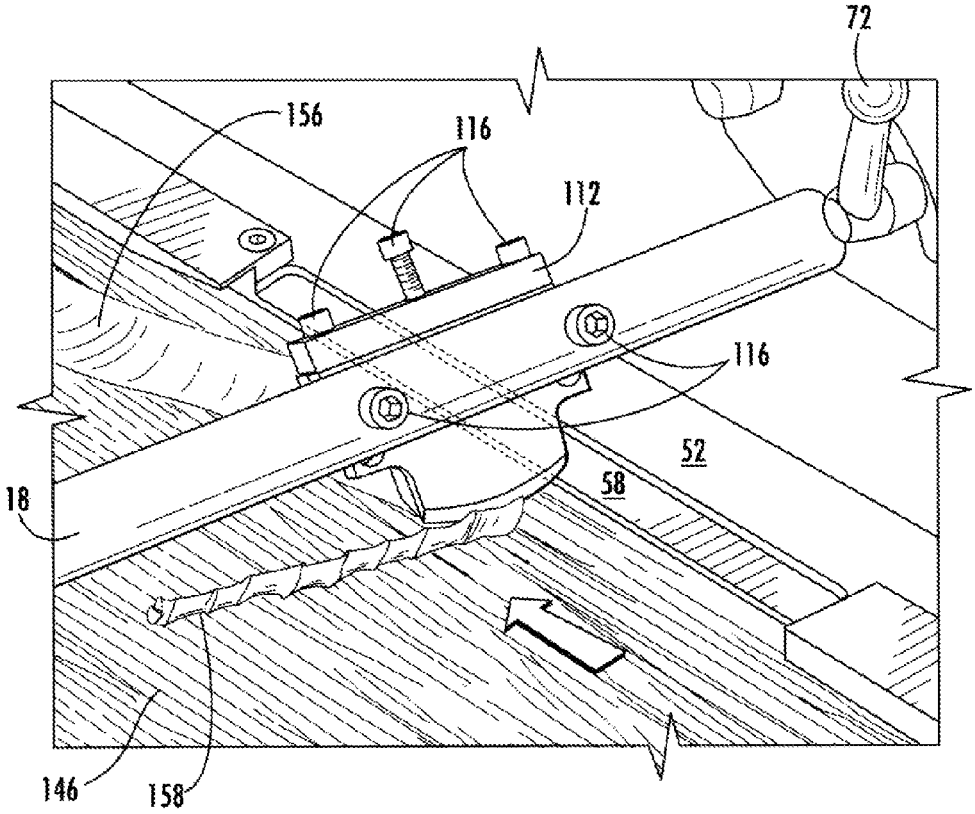
FIG. 14 shows a knife assembly engaging a wood material to produce a scrape ribbon.

As shown in FIGS. 13-16, the wood panel 146 travels through at least one set of scrape arm assemblies and typically a plurality of scrape arm assemblies. As shown in FIG. 14, as the wood is moved through the auto-scrape machine, the knife 60 of the scrape arms 18, 20 create scrape paths of a variety of depths, patterns, and shapes. Depending upon the orientation of the knife, the knife may chatter on the wood or, as shown in FIG. 14, the scrape path 156 may be formed and the knife removes a scrape ribbon 158, which is typically waste. The scrape ribbon has surprisingly been found as particularly useful for use in connection with cattle and horse barn bedding.

Figure 15:
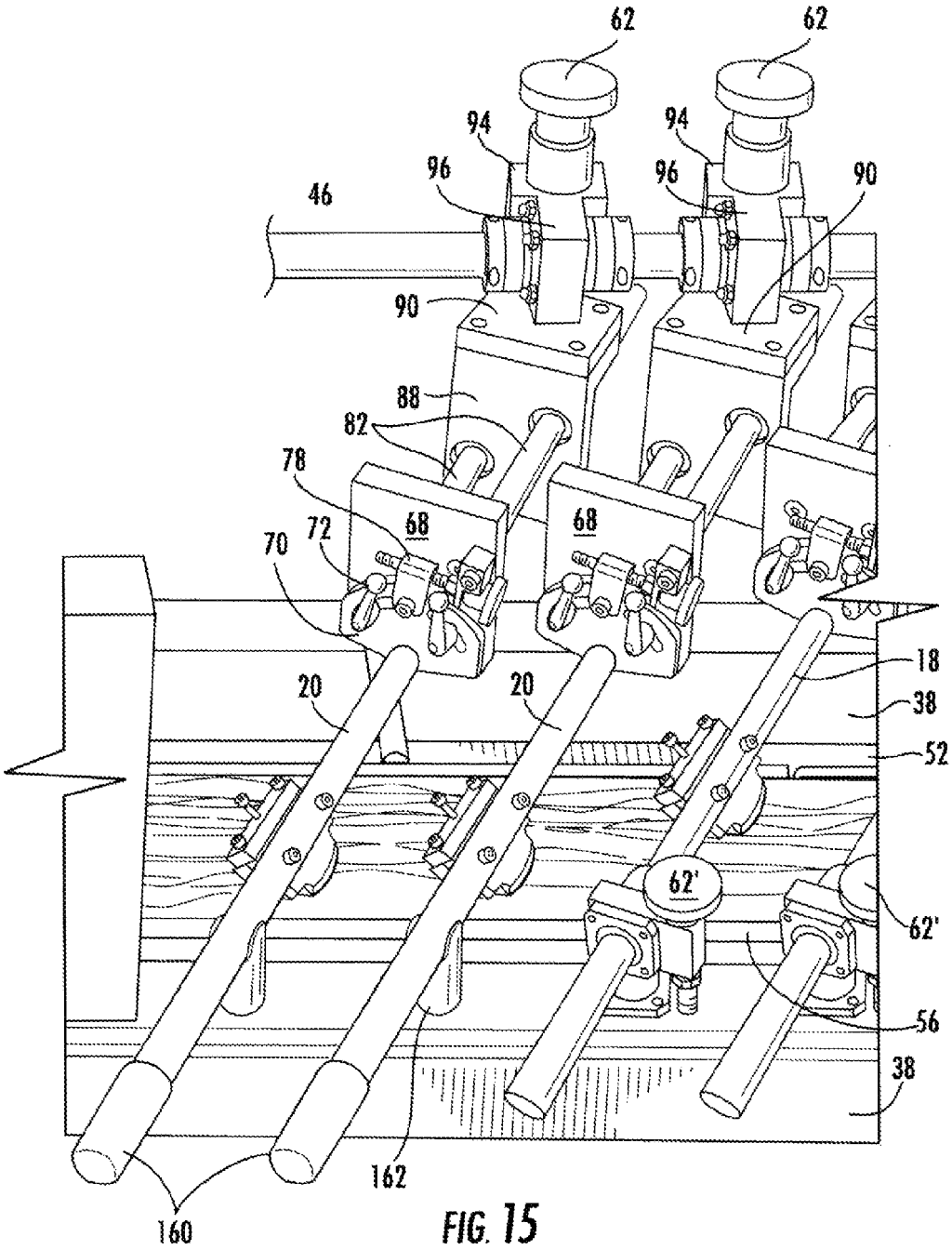
FIG. 15 shows a set of hand actuated scrape arms and automatic scrape arms according to an aspect of the present invention.
Figure 16:
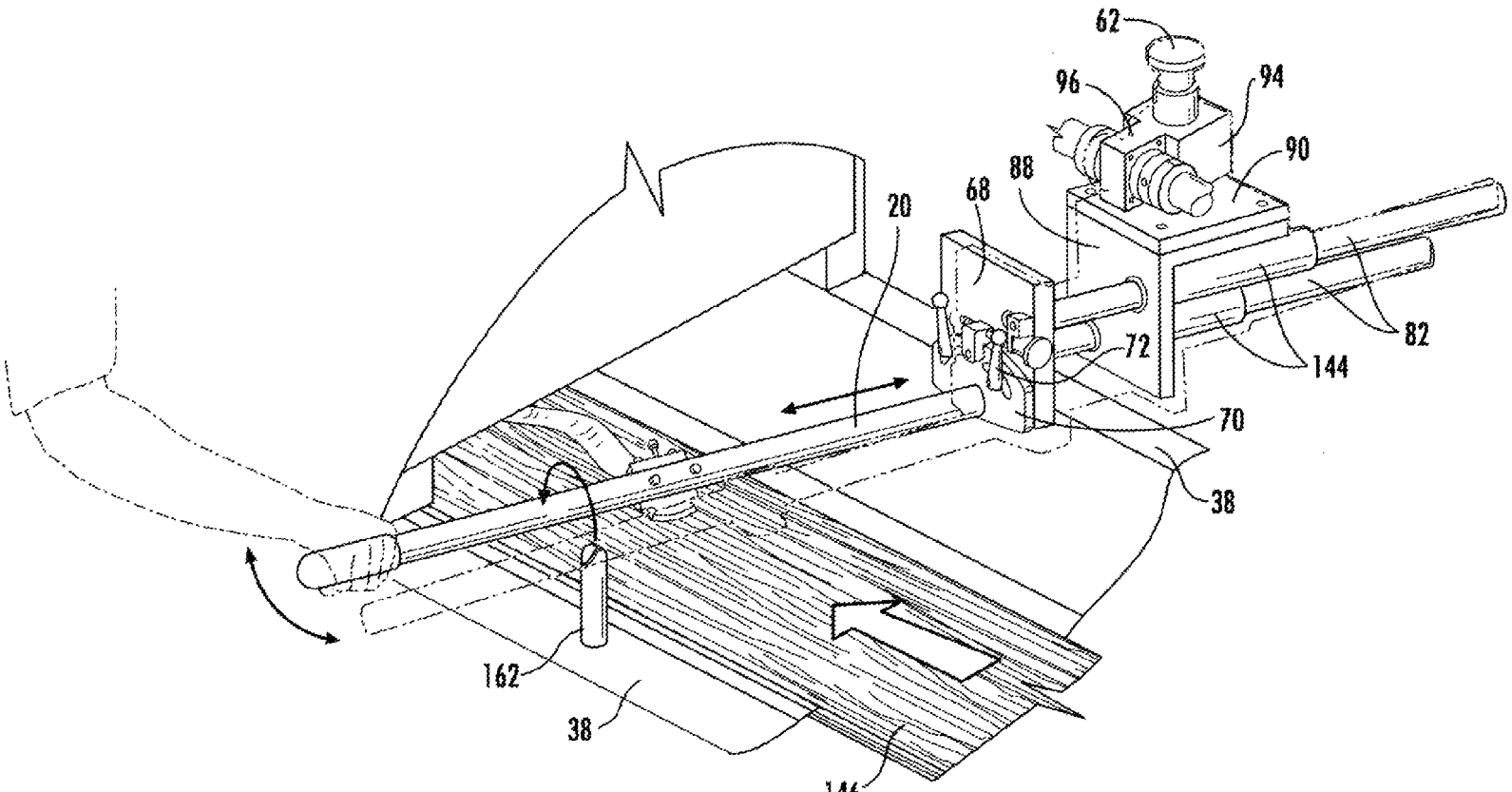
FIG. 16 shows a hand actuated scrape arm assembly according to an aspect of the present invention, illustrating the movements the hand actuated scrape arm assembly can achieve.

As shown in FIG. 15, the auto-scrape machine may incorporate one or a plurality of hand actuated scrape arms 20 that include a handle 160. The hand actuated scrape arms may rest on a hand actuated scrape arm receiving stand 162 mounted on the top surface of the side support section 38. Typically, the stand includes a base portion and two upwardly extending side portions that define a channel that matingly receives the hand actuated scrape arms 20. As can be seen in FIG. 15, the hand actuated scrape arms typically employ two stabilizing bars 82, but could also conceivably utilize four stabilizing bars as the automatic scrape arm assemblies. The hand actuated scrape arms, as shown in FIG. 16, may be manually rotated to adjust the direction of the blade and manually actuated axially up and down and laterally across a piece of wood 146 traveling through the auto-scrape machine 10.

Figure 17:
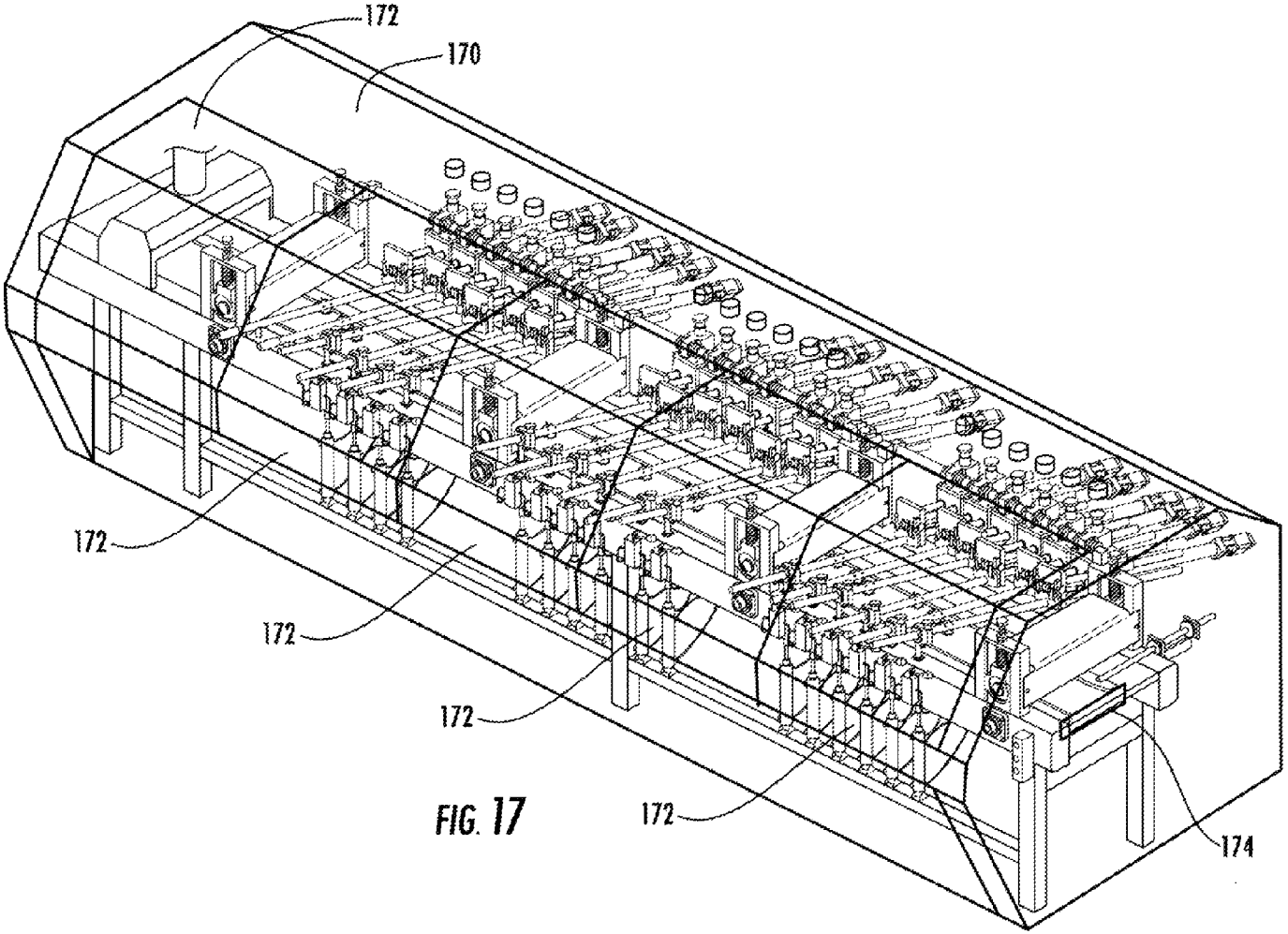
FIG. 17 shows a sound and safety enclosure according to an aspect of the present invention that contains the auto-scrape machine according to an aspect of the present invention.
Figure 18:
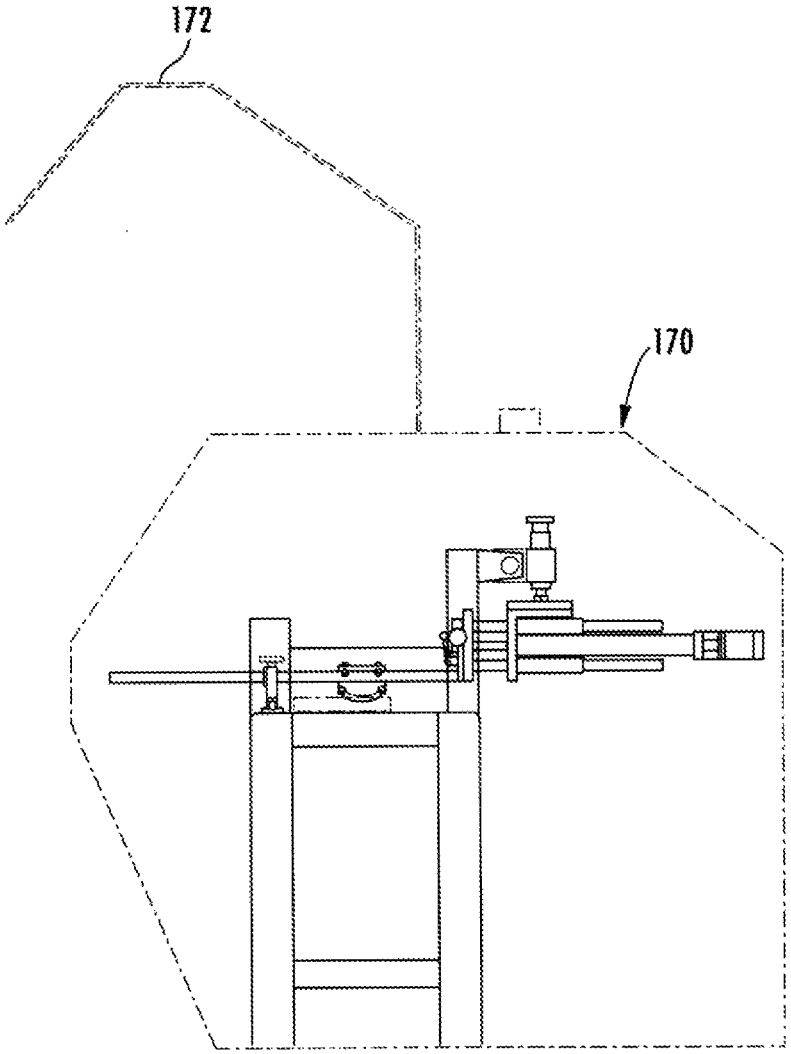
FIG. 18 discloses an end view of the sound and safety enclosure having a main cabin door in the open position allowing access to the auto-scrape machine.

As shown in FIGS. 17 and 18, the auto-scrape machine may be enclosed within a sound/safety enclosure 170 that has one or more, typically a plurality of, main cabin doors 172 that may be opened by an operator to access the auto-scrape machine. If one of the doors 172 is opened, the system typically immediately stops as a safety precaution to ensure operator safety. As shown in FIG. 18, the access door opens to allow liberal access to the auto-scrape machine. As shown in FIG. 17, the enclosure 170 can include an entry opening 174 that receives material to be processed. The entry opening 174 may be used to receive wood products as discussed previously herein. The figures are shown for a system that produces wood planks or panels, such as wood flooring or cabinetry parts. Furniture components and other wood pieces may also be treated and processed by the auto-scrape machine 10.

It will be understood by one having ordinary skill in the art that construction of the described invention and other components is not limited to any specific material. Other exemplary embodiments of the invention disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the invention as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

What is claimed is:

1. An auto-scrape machine comprising:

a frame with a material processing surface and having a first side and a second side on opposite sides of the material processing surface; and a plurality of independently laterally moveable motorized scrape arm assemblies that comprise a rod extending over the material processing surface wherein the motorized scrape arm assemblies are engaged to the first side and the second side of the frame and have at least one knife assembly that is fixed in position when engaged to the rod such that a knife of the knife assembly engages a material being processed on the material processing surface.

2. The auto-scrape machine of claim 1, wherein the at least one knife assembly comprises an upper knife support member and a lower knife support member wherein the lower knife support member comprises a planar knife support section between two upwardly extending side portions and wherein the knife assembly frictionally holds a knife stationary in the knife assembly between the upper knife support member and the lower knife support member.

3. The auto-scrape machine of claim 2, wherein the knife is a moulder knife frictionally held between the upper knife support member and lower knife support member using fasteners that threadably engage with the upper knife support member, lower knife support member or both.

4. The auto-scrape machine of claim of claim 1, wherein the rod is configured to be rotated about a longitudinal axis of the rod and locked in any of a plurality of rotational positions to vary an angle of the knife and locked in place using a clamping mechanism that is configured to prevent rotation of the rod during operation of the auto-scrape machine.

5. The auto-scrape machine of claim of claim 4, wherein the scrape arm assemblies are each mounted to the first side of the frame and a common motorized scrape arm assembly mounting rod that engages the plurality of scrape arm assemblies and the scrape arm assemblies comprise first side engaging end portions and the first side engaging end portions are moveable between a plurality of different heights such that an angle of the knife assembly engagement changes.

6. The auto-scrape machine of claim 5, wherein the rod is engaged to a motorized scrape arm engagement member on a material facing side and the motorized scrape arm engagement member has a rearward side that is engaged to at least four rotation preventing support rods and an actuating rod operably connected to a motor configured to move the moveable motorized scrape arm assemblies wherein the at least four rotation preventing support rods pass through a bracket that engages the motorized scrape arm to the motorized scrape arm assembly mounting rod.

7. The auto-scrape machine of claim 6, wherein the motor is a servo motor operably connected to a controller.

8. The auto-scrape machine of claim 7 further comprising a plurality of motorized scrape arm vertical movement assemblies operably engaged with the second side of the frame and a portion of the motorized scrape arm assemblies distal the first side engaging end portions of the motorized scrape arm assemblies wherein the motorized scrape arm vertical movement assemblies are configured to move the portion of the motorized scrape arm assemblies distal the first side engaging end portions of the motorized scrape arm assemblies between a lower position and at least a second position that is higher than the lower position.

9. The auto-scrape machine of claim 8, wherein the lower position and the second position are manually or automatically adjustable and, when automatically adjustable, operably connected to the controller.

10. The auto-scrape machine of claim 8, wherein the second position and the plurality of different heights of the first side engaging end portions are each controlled by the controller to adjust the angle of the knife assembly engagement with a material being processed.

11. The auto-scrape machine of claim 8, wherein the plurality of motorized scrape arm vertical movement assemblies comprise pneumatic cylinders that are mounted at one end to a secondary side support of the frame positioned below the second side of the frame and wherein the pneumatic cylinders comprise a moving actuating member that extends through the first side and into engagement with the portion of the motorized scrape arm assemblies distal the first side engaging end portions of the motorized scrape arm assemblies and wherein the pneumatic cylinders are operably connected with the controller and the controller is communicatively engaged with a computer network.

12. The auto-scrape machine of claim 11 further comprising a plurality of spaced apart press roller assemblies configured to drive a material being processed by the auto-scrape machine through the machine with sufficient force to scrape the material using the knife assemblies of the motorized scrape arm assemblies without the knife assemblies rotating.

13. The auto-scrape machine of claim 12 further comprising at least one hand actuated, laterally and rotatably moveable scrape arm wherein each hand actuated, laterally and rotatably moveable scrape arm has an engaged knife assembly wherein the knife assembly comprises an upper knife support member and a lower knife support member wherein the lower knife support member comprises a planar knife support section between two upwardly extending side portions and wherein the knife assembly frictionally holds a wood cutting knife stationary in the knife assembly between the upper knife support member and the lower knife support member.

14. The auto-scrape machine of claim 1 further comprising at least one solely manually actuated, laterally and rotatably moveable scrape arm mounted on one end portion to the first side of the frame and wherein each manually actuated, laterally and rotatably moveable scrape arm has an engaged knife assembly that is configured to be brought into contact with material being processed by the auto-scraped machine.

15. The auto-scrape machine of claim 14 further comprising a plurality of spaced apart press roller assemblies configured to drive a material being processed by the auto-scrape machine through the machine with sufficient force to scrape the material using the knife assemblies of the motorized scrape arm assemblies without the knife assemblies rotating.

16. The auto-scrape machine of claim 15, wherein the plurality of independently laterally moveable motorized scrape arm assemblies comprise at least two sets of independently laterally moveable motorized scrape arm assemblies wherein each set includes more than three independently laterally moveable motorized scrape arm assemblies.

17. An auto-scrape machine comprising:

a frame with a processing surface configured to receive a wood material to be processed by the auto-scrape machine and having a first side and a second side on opposite sides of the material processing surface;

a plurality of independently laterally moveable motorized scrape arm assemblies that comprise a rod having a longitudinal axis extending over the material processing surface wherein the motorized scrape arm assemblies are engaged to the first side and the second side of the frame and have at least one knife assembly that is fixed in position when engaged to the rod such that a knife of the knife assembly engages a material being processed on the material processing surface and wherein the motorized scrape arm assemblies are each mounted to the frame and a common motorized scrape arm assembly mounting rod that engages the plurality of scrape arm assemblies and the scrape arm assemblies have two end portions that are moveable between a plurality of different heights such that an angle of the knife assembly engagement changes; and a plurality of spaced apart press roller assemblies configured to drive a material being processed by the auto-scrape machine through the machine with sufficient force to scrape the material using the knife assemblies of the motorized scrape arm assemblies without the knife assemblies rotating; and wherein the auto-scrape machine is configured to process from about 10 to about 35 lineal feet of wood material per minute and create a hand-scraped appearance on a single face of the wood material.

18. The auto-scrape machine of claim 17, wherein the wood paneling is wood flooring and wherein the scrape arm assemblies are each mounted to the first side of the frame and a common motorized scrape arm assembly mounting rod that engages the plurality of scrape arm assemblies and the scrape arm assemblies comprise first side engaging end portions and the first side engaging end portions are moveable between a plurality of different heights such that the angle of the knife assembly engagement changes.

19. The auto-scrape machine of claim 17 further comprising at least one manually actuated, laterally and rotatably moveable scrape arm mounted on one end portion to the first side of the frame and wherein each manually actuated, laterally and rotatably moveable scrape arm has an engaged knife assembly that is configured to be brought into contact with material being processed by the auto-scraped machine; and an enclosure with a plurality of access doors wherein the auto-scrape machine is spaced within the enclosure.

20. A method of processing a wood product through an auto-scrape machine such that the wood product produced has a hand-scraped appearance comprising at least the following steps:

inserting a wood material to be processed into the auto-scrape machine on a material processing surface of the auto-scrape machine;

using a plurality of spaced apart press roller assemblies to drive a material being processed by the auto-scrape machine through the machine by using a toothed motor driven roller to grasp a bottom surface of the wood material and drive the wood material through the auto-scrape machine adjusting a height of each side of each of a plurality of independently and laterally moveable and motorized scrape arm assemblies having a knife assembly engaged to a longitudinally extending rod of the motorized scrape arm assemblies; and passing the wood material into engagement with the knife assemblies of the motorized scrape arm assemblies and with the knife assemblies not rotating about a longitudinal axis of the longitudinally extending rod as the motorized scrape arm assemblies move laterally back and forth across at least a portion of a top surface of the wood product being processed to thereby create a hand-scraped appearance on the top surface of the wood product.

* * * * *